United States Patent [19]

Hayashi et al.

[11] Patent Number: 4,763,495

[45] Date of Patent: Aug. 16, 1988

[54] COMPRESSION MEMBRANE

[75] Inventors: Shoichi Hayashi; Norio Sakai; Hidetoshi Ishihara, all of Nagoya, Japan

[73] Assignee: Mitsubishi Jukogyo Kabushiki Kaisha, Tokyo, Japan

[21] Appl. No.: 868,102

[22] Filed: May 29, 1986

[30] Foreign Application Priority Data

| | | | |
|---|---|---|---|
| May 31, 1985 | [JP] | Japan | 60-118371 |
| May 31, 1985 | [JP] | Japan | 60-118372 |
| Sep. 4, 1985 | [JP] | Japan | 60-195518 |
| Apr. 21, 1986 | [JP] | Japan | 61-91578 |
| Apr. 21, 1986 | [JP] | Japan | 61-91579 |
| Apr. 23, 1986 | [JP] | Japan | 61-94095 |
| Apr. 23, 1986 | [JP] | Japan | 61-94096 |

[51] Int. Cl.[4] ..... D06F 47/06

[52] U.S. Cl. ..... 68/19.1; 68/242; 100/211

[58] Field of Search ..... 68/242, 21, 96, 19.1; 100/211; 29/113 R

[56] References Cited

U.S. PATENT DOCUMENTS

| | | | |
|---|---|---|---|
| 1,878,899 | 9/1932 | Sherts | 100/211 X |
| 3,269,157 | 8/1966 | Ashley | 68/242 |
| 3,477,364 | 11/1969 | Satchell et al. | 100/211 X |
| 3,756,142 | 9/1973 | Gwilliam | 100/211 X |

FOREIGN PATENT DOCUMENTS

| | | | |
|---|---|---|---|
| 0060420 | 9/1982 | European Pat. Off. | 68/242 |
| 741148 | 11/1943 | Fed. Rep. of Germany | 68/242 |
| 1110602 | 7/1961 | Fed. Rep. of Germany | 29/113 R |
| 1386246 | 3/1975 | United Kingdom | 100/211 |

*Primary Examiner*—Philip R. Coe

*Attorney, Agent, or Firm*—Wenderoth, Lind & Ponack

[57] ABSTRACT

The invention resides in a compression membrane for wringing liquid out of an object to be compressed, characterized in that its marginal portion whose width is of the order of 15%–35% of the width in the radial direction of the membrane body is made smaller in stretchability than the other portion, whereby no tear of the object to be compressed does not tear during the dehydration thereof.

5 Claims, 10 Drawing Sheets

COMPRESSION MEMBRANE

BACKGROUND OF THE INVENTION

1. Field of the Invention

This invention relates to a compression membrane adapted for use, for example, in a drainage machine for wringing liquid out of textile products containing liquid.

2. Description of the Prior Art

FIGS. 1 through 5 show an example of the compression section of one conventional hydroextractor. In these drawings, reference numeral 1 indicates a membrane mounted between a stopper 2 and a bell 3, which may be a rubber film for wringing water out of the washing. The stopper 2 is fixed to the inner peripheral wall of the bowl-like bell 3 through, for example, the welding process.

The bell 3 is a pressure retaining vessel for holding a pressurized water 4 within a space formed between it and the membrane 1. Reference numeral 5 indicates a conveyor belt having holes or gaps penetrating therethrough from its upper surface to its under surface, on the under side of which a drainage plate 6 is disposed. This drainage plate 6 has grooves 7 formed in its upper surface for letting liquid run therethrough, whose under side is supported by a frame 8 made of a plate or a structure having a certain strength. Reference numeral 9 indicates clamps for holding and preventing the bell 3 and the conveyor belt 5 from separating from each other, which separation would otherwise occur due to a pressure caused by a hydraulic pressure 10, and each clamp 9 is moved back to the position indicated by the two-dot chain line at the no-dehydration time.

The pressurized water 4 is a pressure water supplied, for example, from a pump not shown, which compresses the washing via the membrane 1. In addition, reference numeral 11 indicates an object to be compressed under pressurization, such as the washing; 12 the object to be compressed before pressurization; 13 the direction of the water flow at the pressurization time (FIG. 1); and 14 the direction of water flow at the negative pressure time (FIG. 2).

Describing the action of the foregoing configuration, FIG. 2 shows the state before pressurization (at the suction time). In this state, the pressurized water 4 is discharged in the direction indicated by reference numeral 14 by, for example, a pump not shown, and the membrane 1 deforms upward along the inner curved surface of the bell 3 so as to assume a convex shape, this membrane being detained at its periphery by the stopper 2.

The bell 3 can move up and down and when it is positioned at the upper position, the object 12 to be compressed having been pre-shaped in the preceding step is conveyed to below the bell 3 by the conveyor belt 5.

Thereafter, the bell 3 lowers to assume the state shown in FIG. 2, and a space 15 is left between the object 12 to be compressed and the membrane 1. Then, each clamp 9 shown in FIG. 1 is moved from the position indicated by the two-dot chain line to the position indicated by the solid line to thereby hold and secure together the frame 8 and the bell 3.

When these members are held and secured by the clamps, the water flowing in the direction 14 is switched by a passage switching unit not shown so as to flow in the direction 13, the object 12 is compressed by means of the pressurized water 4 via the membrane 1, the state shown in FIG. 1 is brought about wherein the object is pressurized, and the water wrung out passes through the holes of the conveyor belt 5 and is discharged outward through the grooves 7 of the drainage plate 6.

As shown in FIG. 3 the conventional membrane 1 is of the form of a flat plate having a hook at its periphery, and is deformed as shown in FIG. 2 as described above and stretched normally by 60–70%; thus, a good stretchable rubber exhibiting an elongation percentage of 300–700% is used. At the drainage time, as shown in FIG. 4, the membrane 1 is deformed so as to conform to the object 12 to be compressed to thereby perform drainage.

According to the foregoing procedure of compressing the object 12, the volume of the object is reduced and its height is decreased to less than one half the original height. However, since the pressurizing direction points downwards, the diameter of the object 12 to be compressed enlarges. For example, an initial diameter of 950 mm increases up to a size of 1000–1050 mm immediately after compression. At this moment, as shown in FIG. 4, pinching portions 17, 18 for pinching the object to be compressed appear at the outer peripheral portion of the membrane 1, the outer peripheral portion of the object 12 to be compressed, such as the washing, is pressed against the conveyor belt 5 by means of the membrane 1, and the volume of the object 12 to be compressed is reduced while its outer peripheral portion is kept in the locked state. Therefore, as the compression step is continued with the outer peripheral portion kept in the locked state, the membrane 1 stretches in the directions of the arrow 19 and moves in the direction of the arrow 20 (see FIG. 5); thus, there arises a fear that the washing exhibiting a slight elongation will be torn.

As shown in FIG. 3, the body portion of the conventional membrane 1 is made by material having a high stretchability into the form of a flat plate with a slight portion of its marginal portion only being made high in hardness. The ratio of that slight portion to the radius is of the order of 0%–10%. Since an outermost peripheral portion 21 only is made high in hardness, when the membrane 1 is mounted so as to assume the state shown in FIG. 5, the membrane 1 cannot come off from the stopper 2; but there appears inevitably a triangular portion 22 between the membrane 1 and the belt 5 in the vicinity of the stopper 2. As a result, the outer peripheral portion of the object 12 to be compressed tends to be locked within the triangular portion 22, and as the object 12 is compressed by the pressurized water 10 via the membrane 1 as shown in FIG. 4, a number of tears will occur in a portion indicated by 23.

In addition, as the pressure of the pressurized water is removed after completion of dehydration in the state shown in FIG. 4, the object 12 having been dehydrated expands and correspondingly pushes the membrane 1 from the inside conversely; thus, the object 12 to be compressed works so as to cut into the membrane 1. During the above action, sliding does not occur if the coefficient of surface friction of the membrane 1 is large, and the space between the membrane 1 and the object 12 to be compressed takes a negative pressure; thus, the object to be compressed is frequently kept in the fastened state to the inner surface of the membrane 1 and lifted up as it is in response to rising of the bell 3.

Therefore, at the subsequent time of dehydrating a next object to be compressed, the preceding object being compressed gets on this next object; thus, the machine comes inconveniently to a stop.

SUMMARY OF THE INVENTION

The present invention has been devised to overcome the foregoing drawbacks of the conventional compression membrane.

Thus, it is one of the principal objects of the present invention to provide an improved compression membrane which does not cause the tensile force of the membrane to act on an object to be compressed even if the object to be compressed is pinched between the marginal portion of the membrane and a belt for conveying the object to be compressed.

It is another of the principal objects of the present invention to provide an improved compression membrane which prevents an object to be compressed from being forced against the membrane at the time of completion of dehydration.

To achieve the foregoing objects, the present invention provides a membrane for wringing liquid out of an object to be compressed which is characterized in that its marginal portion whose width is of the order of 15%–35%, preferably 18%–32%, of the width in the radial direction of the membrane body is made smaller in stretchability than the other portion.

According to the present invention, since the pertinent portion of the outer peripheral margin of the membrane is formed so as to have a smaller stretchability than that of the other portion, even when the membrane is mounted to a bell and compression of the object to be compressed is commenced, stretching of the outer peripheral portion of the membrane is suppressed, and that portion never deforms toward the center of the membrane even while the drainage step is taking place, but moves only in the compression direction. Therefore, even when a part of the object to be compressed is locked in a pinching portion between the marginal portion of the membrane and a conveyor belt, no tensile force acts on the object to be compressed and no portion is torn.

DESCRIPTION OF THE PREFERRED EMBODIMENTS

Embodiments of the present invention will now be describd with reference to the drawings.

Figure 6:
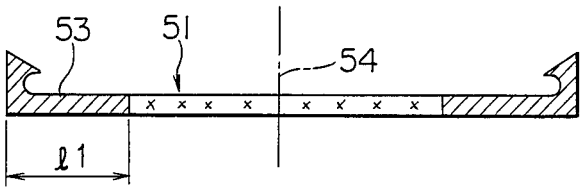
FIG. 6 is a sectional view showing an embodiment of a membrane according to the present invention.

In FIG. 6, reference numeral 51 indicates an embodiment of a membrane according to the present invention whose sectional shape is made identical to that of the conventional one; but, in this embodiment, a substantial width portion of its outer peripheral portion is made higher in hardness and smaller in stretchability than the other portion.

Figure 1:
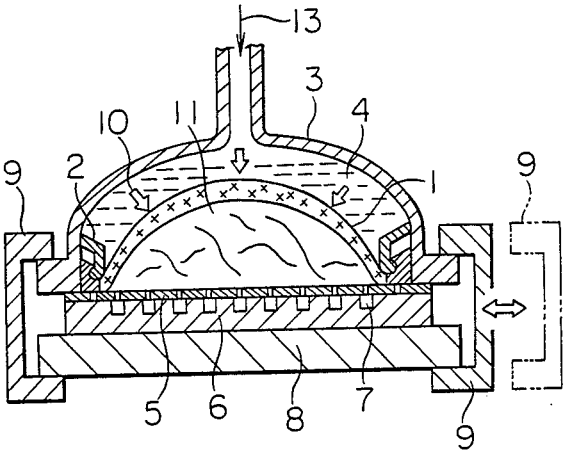
FIG. 1 PRIOR ART
FIG. 1 is a sectional view showing the dehydration state of one conventional hydroextractor.
Figure 2:
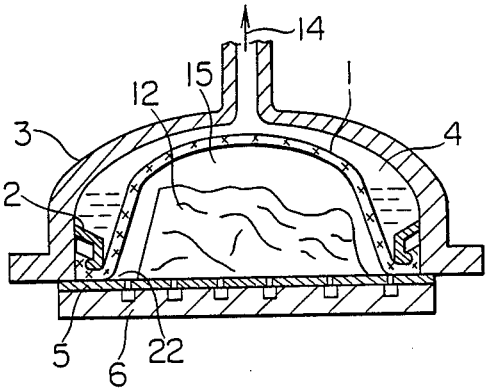
FIG. 2 PRIOR ART
FIG. 2 is a sectional view showing the suction state of the hydroextractor.
Figure 3:
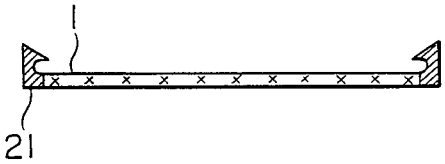
FIG. 3 PRIOR ART
FIG. 3 is a sectional view of one conventional membrane.
Figure 4:
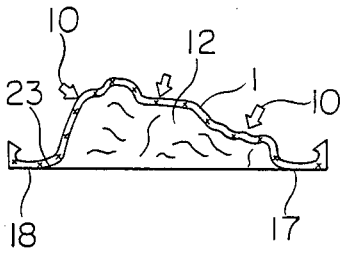
FIG. 4 PRIOR ART
FIG. 4 is a sectional view showing the pressurizing state of the conventional membrane.
Figure 5:
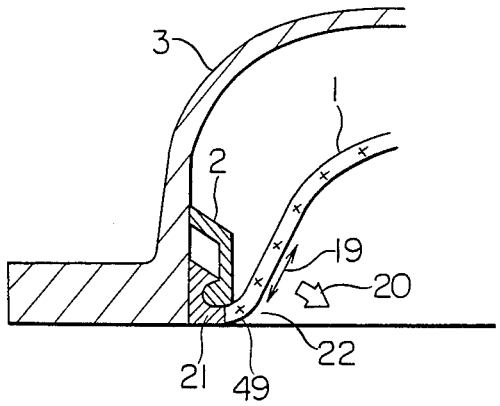
FIG. 5 PRIOR ART
FIG. 5 is a fragmentary sectional view showing the compression state of the conventional membrane.

Describing minutely the foregoing configuration, although in the conventional membrane shown in FIG. 3 its outermost peripheral portion engaged with the stopper 2 of the bell 3 only is made in hardness for reinforcement thereof, according to this embodiment a substantial portion of the membrane 51, which also wraps partially an object to be compressed, including its coupling portion engaged with the stopper 2 and extending beyond a pinching portion 52 formed between the membrane 51 and the conveyor belt, is made high in hardness. Describing further in detail, a shaded portion 53 shown in FIG. 6 has a length $l_1$ corresponding to 15%–35%, preferably 18%–32%, of the radius up to the center 54 of the membrane, and is enhanced in hardness compared to the other portion.

Figure 8:
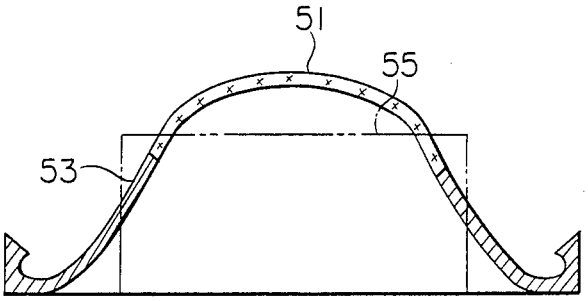
FIG. 8 is a sectional view showing inconvenience arising if the marginal portion enhanced in hardness of the membrane is elongated more than is necessary.

For reference, if the ratio of the shaded portion to the radius were made larger than 35%, a portion of the membrane 51 being rich in stretchability becomes too small, the membrane cannot deform uniformly at the compression time; thereby resulting in the state shown in FIG. 8, in which it cannot wrap the washing 55 completely and achieve a uniform compression, and thus, such a membrane with that ratio is not usable practically.

On the contrary, if that ratio were made smaller than 15%, a marginal portion of the membrane being suppressed in elongation becomes too small, whereby an intended function cannot be achieved.

Figure 7:
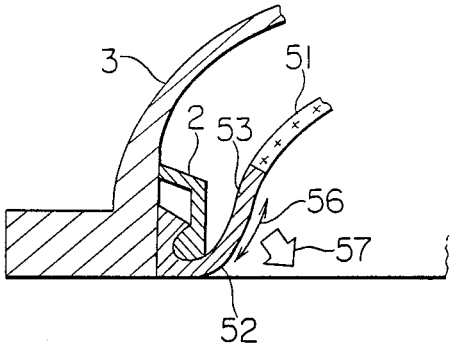
FIG. 7 is a sectional view showing the pressurizing state of the membrane mounted to the hydroextractor.

By making the configuration of a membrane accord with this embodiment, elongation of the outer peripheral portion of the membrane 51 in the directions of the arrow 56 shown in FIG. 7 is suppressed and does not deform in the directions of the arrow 56, i.e. toward the center of the membrane 51 during the drainage step, but changes only in the direction of the arrow 57, i.e. in the direction of compressing the object to be compressed. Therefore, even if the object to be compressed is locked by the pinching portion 52, no tensile force acts on the object to be compressed and no tear occurs.

Data obtained by applying the membranes according to the present invention, the hardness of whose marginal portion is increased, and the conventional products to the dehydration step of the washing are listed for comparison in Table 1.

TABLE 1

| Radial Ratio (%) of Hardness-Enhanced Portion | Percentage (%) of Tear of the Washing | Dehydrated Results of the Washing |
|---|---|---|
| Reference Product | | |
| 12 | 1.123 | inferior (tears appeared) |
| Products of the Present Invention | | |
| 15 | 0.864 | fine |
| 18 | 0.725 | fine |
| 22 | 0.653 | fine |
| 26 | 0.595 | fine |
| 30 | 0.524 | fine |
| 35 | 0.550 | fine |
| Reference Product | | |
| 38 | 0.612 | inferior (corners of the washing crushed) |
| Prior Art Products | 1.5–1.6 | inferior (tears appeared) |

Figure 9:
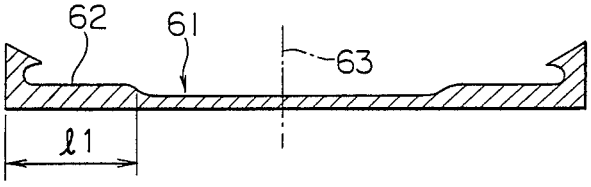
FIGS. 9 and 10 are sectional views showing another embodiment of the membrane according to the present invention and its working state, respectively.

FIG. 9 shows another embodiment of the present invention, in which the marginal portion 62 of a rubber membrane 61 having a width $l_1$ corresponding to 15%–35%, preferably 18%–32%, of the radius up to the center 63 is made larger in rubber thickness and smaller in stretchability than the other portion.

Figure 10:
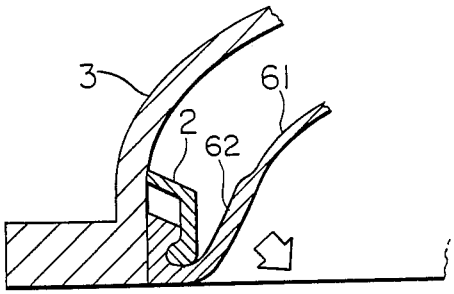

FIG. 10 shows the pressurizing state of the membrane 61 mounted to the hydroextractor. The action and effect of the membrane 61 are substantially identical to those of the first-mentioned embodiment, and thus are not described again. For reference, if the hardness of the marginal portion 62 is made lager than that of the other portion, the rubber thickness of the marginal portion 62 can be reduced compared to the case where all portions of the membrane are made as having the same hardness.

Figure 11:
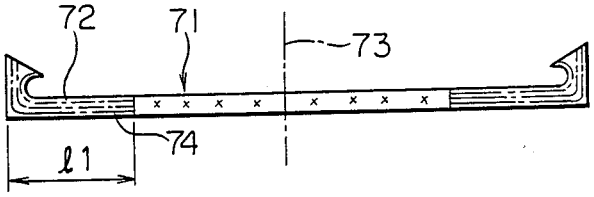
FIGS. 11 and 12 are sectional views showing yet another embodiment of the membrane according to the present invention and its working state, respectively.

FIG. 11 shows yet another embodiment of the present invention, in which the marginal portion 72 of a rubber membrane 71 having the width $l_1$ corresponding to 15%–35%, preferably 18%–32%, of the radius up to the center 73 has a reinforcing member 74, made of nylon, cotton, polyester, or other elastic material, mixed with the rubber and/or bonded to the surface of the marginal portion 72, whereby the stretchability of the marginal portion 72 is smaller than that of the other portion.

Figure 12:
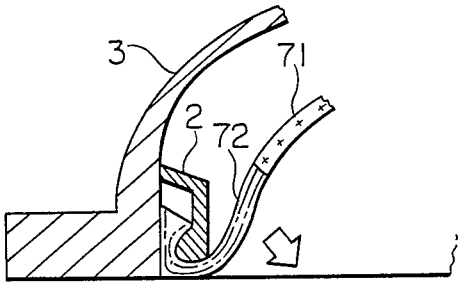

FIG. 12 shows the pressurizing state of the membrane 71 mounted to the hydroextractor. The action and effect of the membrane 71 are substantially identical to those of the embodiments above, and thus are not described again. The reinforcing member 74 may be embedded in the marginal portion 53 of the membrane 51 shown in FIG. 6. Further, this member 74 may be embedded in the marginal portion 62 having a large rubber thickness of the membrane 61 shown in FIG. 9. In this case, the rubber thickness of the marginal portion 62 can be decreased.

Figure 13:
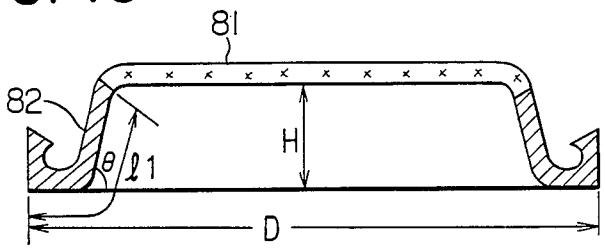
FIGS. 13 and 14 are sectional views showing yet another embodiment of the membrane according to the present invention and its working state, respectively.

FIG. 13 shows yet another embodiment of the present invention, in which the marginal portion, i.e. the shaded portion 82, of a membrane 81 having the width $l_1$ corresponding to 15%–35%, preferably 18%–32%, of the radius of the membrane is increased in hardness, similarly to the embodiment of FIG. 6; but, in this embodiment, the marginal portion 82 is erected so as to assume the form of a dish or a bowl in cross section so that its shape is analogous as a whole to that of the object to be compressed after drainage.

Figure 14:
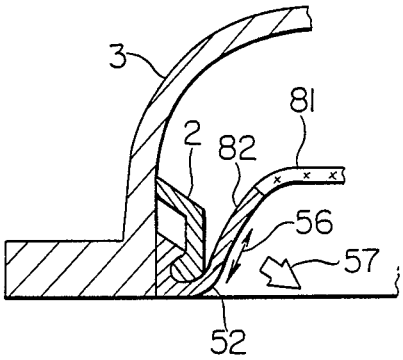

FIG. 14 shows the action of the membrane 81 shown in FIG. 13 mounted to the hydroextractor and the like.

During the drainage step, the high-hardness marginal portion 82 of the membrane 81 moves only in the direction of the arrow 57(in the compression direction of the object to be compressed) and no tensile force acts on the object to be compressed even when there is formed a lock portion indicated by reference numeral 52; thus, the compression force only is applied and the object to be compressed cannot be torn.

Further, because the sectional shape of the membrane 81 is previously made so as to conform substantially to the shape of the object to be drained as shown in FIG. 13, the hardness-enhanced portion of the marginal portion 82 receives no force in the direction of the arrow 56 shown in FIG. 14, i.e. in the radial direction of the membrane 81; thus, this configuration is especially effective.

Specifically, when the erected portion of the bowl-like marginal portion 82 is made so as to take an inclination angle larger than 30° and the height H of that portion 82 is set to a value coming under (1.0 to 6.0)$\times W/D^2$mm, where D is the diameter (m) of the membrane body and W is the dry weight (Kg) of the object to be compressed, the percentage of tear of the washing becomes low and a finely dehydrated result is obtained.

For reference, if H were set to a value outside the range from $10\times W/D^2$ to $6.0\times W/D^2$, the membrane 81 must be made of a rubber having a high elongation percentage for easy elongation thereof, as a result, the outer peripheral portion of the membrane 81 tends to deform in the direction of the arrow 56 shown in FIG. 14, i.e. toward the center of the membrane 81; thus, an intended function cannot be attained.

Figure 15:
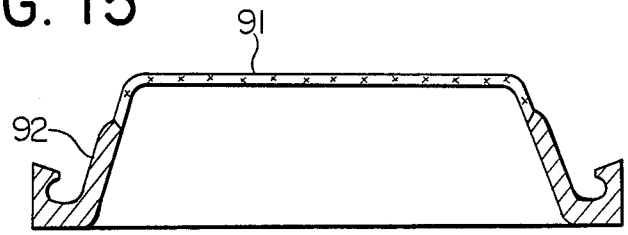
FIGS. 15 and 16 are sectional views showing other embodiments of the membrane according to the present invention, respectively.

FIG. 15 shows yet another embodiment of the present invention, in which the bowl-like marginal portion 92 of a membrane 91 is made larger in rubber thickness and smaller in stretchability than the other portion.

Figure 16:
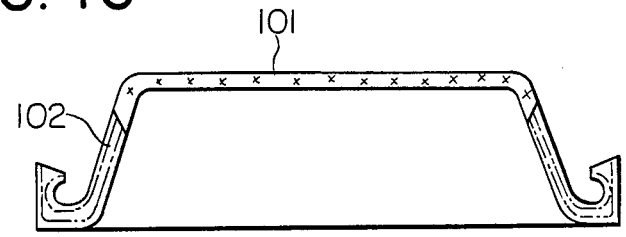

FIG. 16 shows yet another embodiment of the present invention, in which the bowl-like marginal portion 102 of a membrane 101 has a reinforcing member made of nylon, polyester, cotton, etc. mixed with the rubber and/or bonded to the surface thereof, whereby the stretchability of the bowl-like marginal portion 102 is made smaller than that of the other portion.

Having described the several embodiments of the membrane whose bowl-like marginal portion is improved so as to decrease its stretchability, it will be apparent that the combinations of these embodiments also give a good result.

Figure 17:
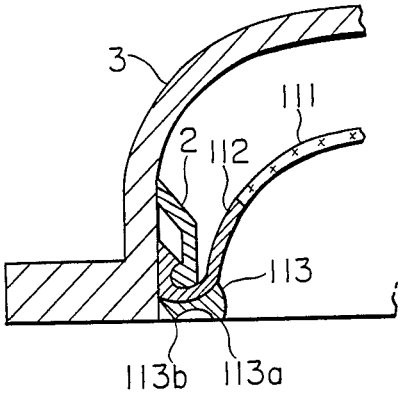
FIGS. 17 and 18 are sectional views showing yet another embodiment of the membrane according to the present invention and its working state, respectively.

FIG. 17 shows yet another embodiment of the present invention, in which the marginal portion 112 of a membrane 111 is enhanced in hardness compared to the other portion, similarly to the embodiment shown in FIG. 6. In this embodiment, the reverse surface to the coupling surface engaged with the stopper 2, of the membrane 111 has a shielding member 113 bonded to or formed integrally therewith.

Figure 18:
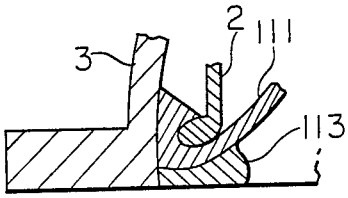
Figure 19:
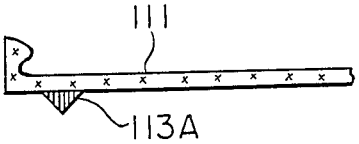
FIGS. 19 and 20 are sectional views showing yet another embodiment of the membrane according to the present invention and its working state, respectively.
Figure 20:
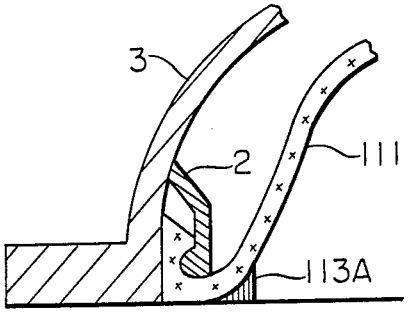
Figure 21:
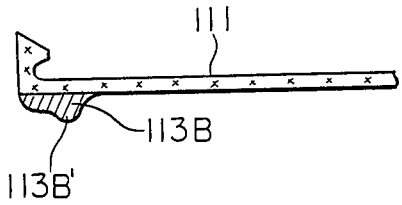
FIGS. 21, 22, and 23 are sectional views showing yet another embodiment of the membrane according to the present invention and its working states, respectively.

This shielding member 113 creates lip portions 113*a*, 113*b* while the membrane 111 is in the suction state and is deformed flat as shown in FIG. 18 while in the pressurizing state, whereby the object to be compressed is prevented from being pinched. According to this configuration, any portion of the object to be compressed cannot be locked and the membrane 111 does not change in shape in the portion of the shielding member; thus, the effect of preventing pinching of the washing is improved further.

Although the shielding member 113 may be made by material having the same hardness as that of the membrane 111, if the hardness of the shielding member is set to, for example, $H_s$ 70°–$H_s$ 90° which is higher than that of the membrane 111, the shielding member can hardly collapse even at the compression time of the washing, i.e. even in the pressurizing state of the membrane 111, and maintains easily the state shown in FIG. 18 even at the compression time, whereby the inner shape of the marginal portion of the membrane can be preserved well with an intended height.

Figure 22:
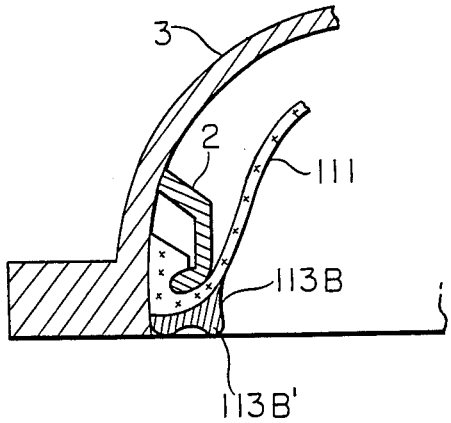
Figure 23:
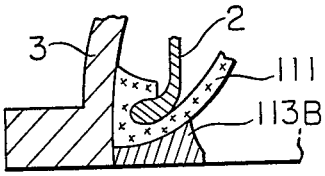

FIGS. 19 through 30 show other embodiments of the present invention. The embodiment shown in FIG. 19 has a shielding member 113A shaped triangular in cross section. In the embodiment shown in FIG. 21, a shielding member 113B whose under surface is shaped like a waveform in cross section has in its inner marginal portion a lip portion 113B′ and is secured integrally to the surface marginal portion of the membrane 111. FIG. 22 shows the state in which no external force is applied to the membrane 111, that is, it shows the state in which the membrane 111 is secured to the bell 3 with the stopper 2 engaged therewith and assumes a curved shape conforming to the inner curved surface of the bell 3 by sucking up the pressurized water. FIG. 23 shows the state in which the membrane 111 is pressurized by supplying the pressurized water into the bell 3, so that the portion wave-shaped in cross section is made flat and the lip portion 113B′ is deformed so as to stick tightly to the surface of the conveyor belt.

Figure 24:
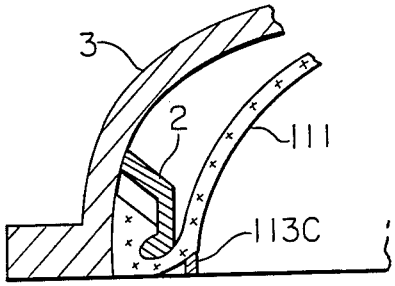
FIG. 24 is a sectional view showing the working state of yet another embodiment of the membrane according to the present invention.

FIG. 24 shows yet another embodiment, in which a shielding member 113C of trapezoidal shape in cross section is used instead of the shielding member of triangular shape in cross section.

Although in the foregoing embodiments all of the shielding members are made independent of the membrane 111 and each secured to the membrane 111 so as to form a single body, the shielding member is not absolutely necessary to be made independent, different from those embodiments. Examples of the integral type are shown in FIGS. 25 through 28, in which a projection portion 113D, 113E is provided on the surface marginal portion of the membrane 111 so as to give the form of a single body.

Figure 25:
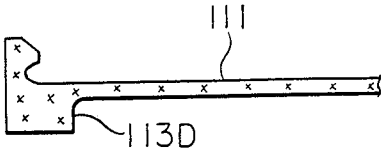
FIGS. 25 and 26 are sectional views showing yet another embodiment of the membrane according to the present invention and its working state, respectively.
Figure 26:
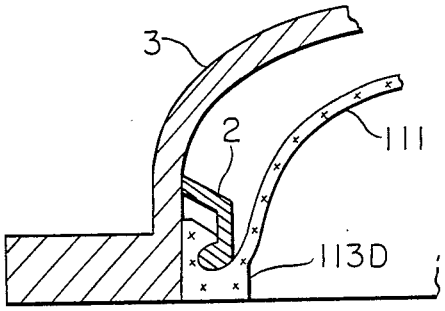
Figure 27:
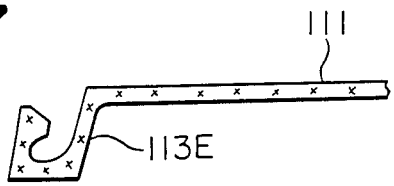
FIGS. 27 and 28 are sectional views showing yet another embodiment of the membrane according to the present invention and its working state, respectively.
Figure 28:
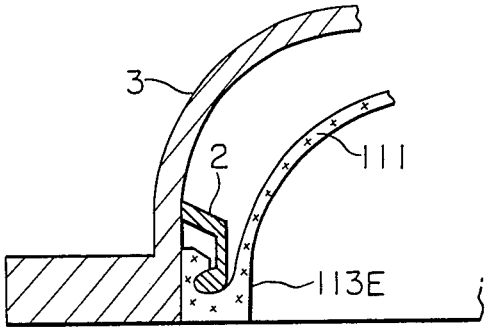

Specifically, one example is shown in FIG. 25, in which the projection portion 113D of rectangular shape in cross section is formed integrally on the marginal portion of the body surface of the membrane 111. The other is shown in FIG. 27, in which the shielding member 113E integrally formed is substantially U-shaped in cross section so as to project the body marginal portion of the membrane 111 toward the side of the surface. Each shielding member, 113D, 113E, creates the erected portion of the membrane 111 as shown in FIGS. 26 and 28, respectively, at the pressurization time of the membrane 111 to thereby provide a shielding portion for preventing the outer marginal portion of the washing from coming into the gap formed between the membrane 111 and the conveyor belt.

Figure 29:
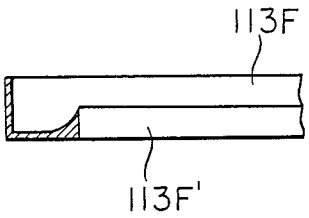
FIGS. 29 and 30 are sectional views showing yet another embodiment of the membrane according to the present invention and its working state, respectively.
Figure 30:
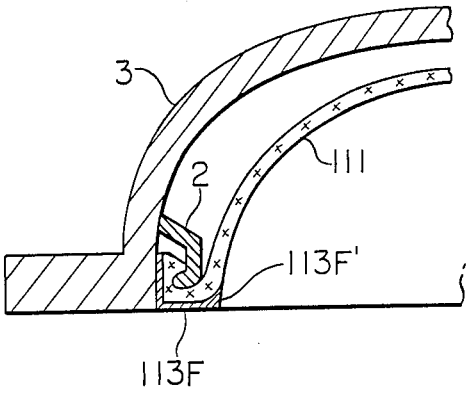

Further, the foregoing shielding members are not absolutely necessary to be made integral with the membrane 111. For example, as shown in FIGS. 29 and 30, a ring 113F L-shaped in cross section may be made independent and held by the bell 3 and the like to provide the shielding member. In this embodiment, the inner peripheral surface of the member L-shaped in cross section is flat and has an erected porton 113F′ gradually rising from the flat portion. The experiment proved that: when the outer marginal portion of the washing was pinched by about two sheets by the foregoing pinching portion, the percentage of tear of the washing reached 90%. But, when five or more sheets were pinched, the outer marginal portion of the washing became thick and increased its strength, so that the washing became hard to be torn and easy to get off from the pinching portion.

Further, according to the present invention, it was also confirmed by the experiment that: when the height of the shielding member was set to a size larger than the total height of five sheets of the washing, tear could completely be prevented from occurring.

For reference, when the shielding member was added to the membrane whose radial ratio of hardness-enhanced portion (marginal portion) is 26%, the percentage of tear listed in Table 1 is decreased to 0.389%.

Figure 31:
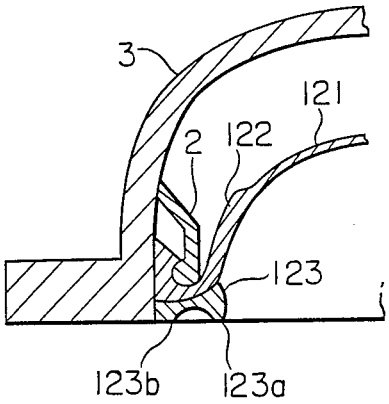
FIGS. 31 and 32 are sectional views showing the working states of yet another embodiment of the membrane according to the present invention, i.e. the suction state and the pressurizing state, respectively.
Figure 32:
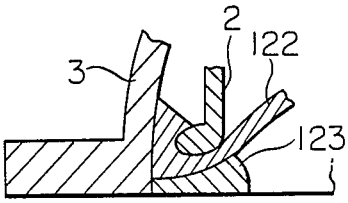

FIG. 31 shows yet another embodiment of the present invention, in which the marginal portion 122 of a membrane 121 is made larger in rubber thickness than the other portion. A shielding member 123 is bonded to or formed integrally with that portion 122, so that when the membrane 121 is in the suction state the shielding member 123 creates lip portions 123*a* and 123*b*, and when it is in the pressurizing state the shielding member is made flat to thereby prevent pinching of the object to be compressed, as shown in FIG. 32.

Figure 33:
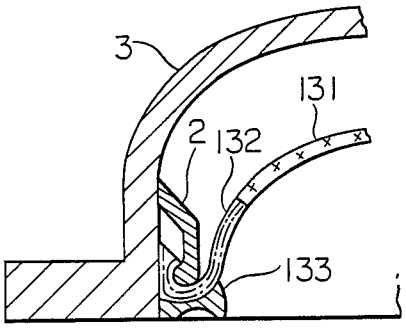
FIGS. 33 and 34 are sectional views showing the working states of yet another embodiment of the membrane according to the present invention, respectively.

FIG. 33 shows yet another embodiment of the present invention, in which a reinforcing member 133 is added to the marginal portion 132 of a membrane 131, that is, this shielding member 133 is bonded to or formed integrally with the marginal portion 132. The action and effect of the membrane 131 are substantially identical to those of the foregoing embodiments, and thus are not described again.

Figure 34:
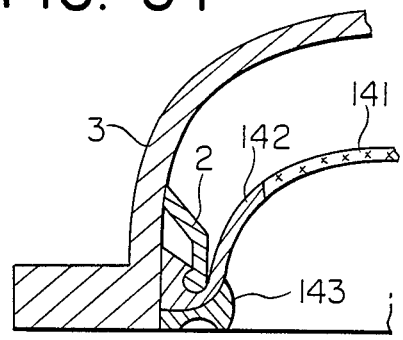

FIG. 34 shows yet another embodiment of the present invention, in which a shielding member 143 is attached to the bowl-like marginal portion 142 of a membrane 141. The bowl-like marginal portion 142 is made higher in hardness, or larger in rubber thickness than the other portion, or a reinforcing member is added to that portion, or some combinations of the above measures are incorporated. The action and effect of the membrane 141 are substantially identical to those of the foregoing embodiments, and thus are not described again.

Figure 35:
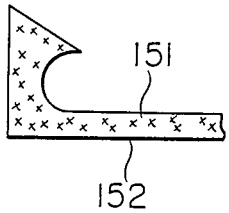
FIG. 35 is a sectional view showing yet another embodiment of the membrane according to the present invention.

FIG. 35 shows yet another embodiment of the present invention, in which the marginal portion of a membrane 151 is made higher in hardness than the other portion, and its surface contactable with the object to be compressed is finished entirely into a thin-layered smooth-processed surface 152.

Formation of this smooth-processed surface 152 is achieved by coating or bonding resin and the like having a small friction coefficient, such as fluorine resin, on the surface of the membrane 151. Or, taking into consideration the fact that a material such as rubber having a low degree of hardness makes difficult sliding between it and the object to be compressed, the surface of the membrane 151 may be subjected to the hardening process so that an extremely thin-layered portion (of the order of some microns to hundreds microns) on the surface possesses a hardness larger than $H_S$ 75°.

Further, the surface thus hardened may be subjected to the smoothing process.

In the present invention, all the foregoing processes are named the smoothing process and used herein.

Figure 36:
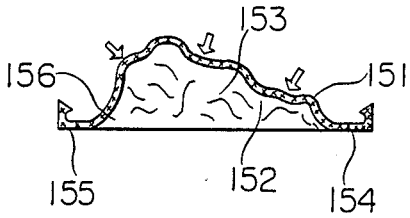
FIG. 36 PRIOR ART
FIGS. 36 and 37 are sectional views showing the states at the time of completion of drainage when the conventional membrane and the membrane shown in FIG. 35 are used, respectively.
Figure 37:
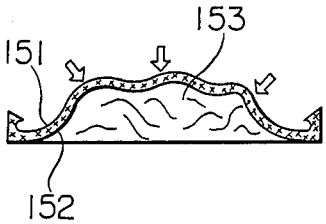

Describing the action of the membrane assembled, for example, in the compressing unit of the washing machine, if the membrane 151 is subjected to the foregoing process to enhance sliding of its surface, the washing 153 can always take an averaged posture as a whole after dehydration as shown in FIG. 37 even when the washing 153 had an offset before dehydration as shown in FIG. 36. Accordingly, it is possible to make the washing uniform in percentage of residual water and there arises no inconvenience in drying, ironing, etc. of the subsequent steps. Specifically, in a step, such as drying or ironing, its processing conditions must be set in compliance with a portion of the washing having the highest percentage of residual water and then the washing must be dried, for instance. As a result, the other portion tends to be over-dried so that the fiber is damaged. However, if the percentage of residual water is made uniform, it is possible to prevent the fiber from being damaged and reduce an energy loss.

As will be apparent from the foregoing description, when the conventional membrane 151 is used, the washing 153 before dehydration is compressed from above by the membrane 151, and its height is reduced to smaller than one-half, thereby being collapsed in the diametral direction to become widened. If the surface of the membrane 151 is not subjected to the smoothing process, as shown in FIG. 36, there appear pinching portions 154, 155 confined by the membrane 151 and the conveyor belt 5, the washing 153 is gathered about the center by the pressure applied from the circumference, and the washing is damaged at a portion indicated by reference numeral 156. On the contrary, by the use of the membrane 151 whose surface is subjected to the smoothing process so that its friction coefficient is made smaller than 1.0, the washing 153 can easily escape from the pinching portions 154, 155 and not be damaged, this being proved by many experiments done.

Further, even if the washing is expanded when the pressure of the pressurized water is released at the time of completion of dehydration, relative sliding between the washing and the membrane is maintained well, the clasping action of the membrane does not occur, sticking of the washing to the membrane is prevented, and the machine is prevented from coming to a stop.

The smoothing process used in finishing the surface of the membrane contactable with the object to be compressed is applicable equally to the membrane whose marginal portion is made higher in hardness than the other portion, the membrane whose marginal portion is made larger in rubber thickness than the other portion, the membrane having the reinforcing member added to its marginal portion, and membranes incorporating combinations of the foregoing measures.

Further, the smoothing process of the membrane is also applicable to the membrane having the bowl-like marginal portion, and in this case the percentage of tear listed in Table 1 is lowered to 0.050%.

In addition, the smoothing process is also applicable to the membrane having the shielding member.

Figure 38:
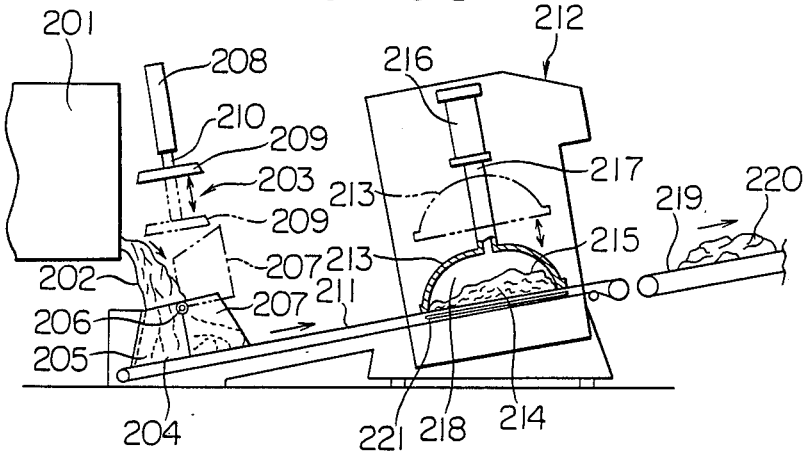
FIG. 38 is a vertical sectional view showing the important portion of a dehydrating device using the membrane according to the present invention.

In FIG. 38, reference numeral 201 indicates a continuous washing machine which operates so as to throw the washing 202 of a certain lot intermittently into a hollow housing 204 of a pre-dehydrating unit 203. The housing is composed of a fixed drum 205 having a plurality of small drainage holes formed in its outer periphery and a rotary drum 207 having also a plurality of small holes formed in its outer periphery which is rotated about a pin 206 up to the position indicated by the two-dot chain line by means of an air cylinder not shown.

Reference numeral 208 indicates a pre-pressing air cylinder disposed above the housing 204, which has a pushing plate 209 attached to the top of piston rod 210 so that the pushing plate 209 is liftable in the housing 204. Reference numeral 211 indicates a conveyor belt arranged between the pre-dehydrating unit 203 and a main dehydrating unit 212, which has a plurality of small drainage holes formed therein. Reference numeral 213 indicates a bowl-like member having a membrane 215, such as a diaphragm, mounted to its opening margin, which can wrap the washing 214 pre-dehydrated. Reference numeral 216 indicates a lifting air cylinder having the bowl-like member 213 attached to the top of a piston rod 217 which is liftable.

Reference numeral 218 indicates a pressurizing chamber communicating with the lifting air cylinder 216 connnected to a pressure liquid tank, pump, etc. not shown and the hollow piston rod 217 for conducting the pressure liquid, which operates in such a manner that the membrane 215 comes into contact with the inner wall of the bowl-like member 213 and at the time of main dehydration, loosens to push the surface of the washing 214. Reference numeral 219 indicates an ejecting conveyor for conveying the washing 220 after main dehydration to a drier not shown. Reference numeral 221 indicates a drainage plate secured to a frame not shown and disposed between the upper and the lower parts of the conveyor belt 211, having drainage grooves formed in its surface.

The foregoing batch type dehydrating device is known and disclosed, for example, in Japanese Patent Laid-Open No. 50-50764. In such a dehydrating device, the washing 202 supplied from the continuous washing machine 201 is received in the housing 204, and the pushing plate 209 is lowered in response to actuation of the pre-pressing air cylinder 208 to pre-dehydrate the washing 202 to thereby put it into the form of a cake.

Subsequently, the rotary drum 207 is rotated up to the position indicated by the two-dot chain line, and the conveyor belt 211 is moved in the direction of the arrow, so that the cake is conveyed to below the bowl-like member 213 of the main dehydrating unit 212. As the washing 214 reaches below the bowl-like member 213, the conveyor belt 211 stops. Then, the bowl-like member 213 is lowered by means of the lifting air cylinder 216 to wrap the washing 214 existing on the conveyor belt 211. Thereafter, by the use of the clamps not shown, the bowl-like member 213, membrane 215, conveyor belt 211, drainage plate 221, etc. are clamped into a single body.

Upon completion of clamping, the pressure liquid (normally, water is used therefor) is conducted into the pressurizing chamber 218 by means of a pressure liquid tank, pump, etc. not shown and the membrane 215 starts to move down, thereby coming into contact tightly with the washing 214. The pressure liquid is further conducted into the pressurizing chamber 218 to press the washing 214 via the membrane 215, whereby the washing 214 is dehydrated.

Upon completion of dehydration of the washing 214, the clamps (not shown) are released, the pressure liquid is discharged from the pressurizing chamber 218, the bowl-like member 213 and the membrane 215 are lifted up, and the washing 220 thus dehydrated is conveyed to the drier (not shown) by means of the conveyor 219.

Consequently, there is provided the dehydrating device using as the membrane 215 one of those of the foregoing embodiments which obviates occurrence of tear of the washing in the dehydration step.

What is claimed is:

1. A compression membrane constructed for wringing liquid out of a textile product, said membrane having a membrane body with a center, a radius, a marginal peripheral portion in a radial direction from said center, and a remaining portion, wherein said marginal peripheral portion has a width in said radial direction of 15–35% of said radius, and said marginal peripheral portion has a higher degree of rubber hardness, and therefore a smaller degree of stretchability, than that of said remaining portion, and a portion of said marginal peripheral portion adjacent to said remaining portion has substantially the same thickness as said remaining portion, said membrane being constructed such that during the wringing said marginal peripheral portion will contact the textile product to a substantial extent without exerting tensile force on the textile product.

2. A compression membrane according to claim 1, wherein the surface of the membrane contactable with an object to be compressed is subjected to a smoothing process.

3. A compression membrane according to claim 1, wherein a shielding member having a height desirable for it to fit in a space portion of triangular shape in cross section formed between the marginal portion of the membrane body and a conveyor belt for conveying an object to be compressed is disposed around that marginal portion.

4. A compression membrane according to claim 1, wherein the marginal portion of the membrane body is erected with an angle larger than 30° so as to form a bowl-like portion, and the height H of the bowl-like portion is set to a value coming under (1.0 to 6.0)$\times W/D^2$mm, where D is the diameter (m) of the membrane body and W is the dry weight (Kg) of an object to be compressed.

5. A dehydrating device including a membrane set forth in claim 1, which comprises a pre-dehydrating unit and a main dehydrating unit arranged between a continuous washer and a drier, said pre-dehydrating unit comprising a substantially cylindrical housing consisting of a fixed drum and a rotary drum for storing the washing therein, and said main dehydrating unit comprising a liftable pressurizing body and said membrane for forming a pressurizing chamber between it and said pressurizing body.

* * * * *